US005161392A

United States Patent [19]

Wiriath et al.

[11] Patent Number: 5,161,392

[45] Date of Patent: Nov. 10, 1992

[54] CIRCULAR PIECE OF JEWELRY COMPRISING AN OUTER BAND WHICH ROTATES AND PROCESS FOR MANUFACTURE

[75] Inventors: Bruno Wiriath, Paris; Raymond J. Georges, Schaeffersheim, both of France

[73] Assignee: Or-Est S.A., Erstein, France

[21] Appl. No.: 749,920

[22] Filed: Aug. 26, 1991

[51] Int. Cl.[5] ..... A44C 9/00

[52] U.S. Cl. ..... 63/15.7

[58] Field of Search ..... 63/15, 15.1, 15.2, 15.3, 63/15.4, 15.7

[56] References Cited

U.S. PATENT DOCUMENTS

| | | | |
|---|---|---|---|
| 1,327,606 | 1/1920 | Bacharach | 63/15.2 |
| 1,586,606 | 6/1926 | Cain | 63/15.4 |
| 1,599,811 | 9/1926 | Eliasoff | 63/15.3 |
| 1,712,417 | 5/1929 | Beaujard, Jr. | 63/15.3 |
| 2,060,345 | 11/1936 | Phillips | 63/15.3 |
| 2,128,644 | 8/1938 | Gittler | 63/15 |
| 2,812,604 | 11/1957 | Nelson | 63/15.3 |
| 3,877,249 | 4/1975 | Sager | 63/15 |
| 4,226,094 | 10/1980 | Wolpoff | 63/15.4 |
| 5,027,617 | 7/1991 | Bonchek | 63/15.3 |

FOREIGN PATENT DOCUMENTS

| | | | |
|---|---|---|---|
| 25697 | 3/1883 | Fed. Rep. of Germany | 63/15.4 |
| 518718 | 5/1921 | France | 63/15.4 |
| 634323 | 2/1928 | France . | |
| 842140 | 6/1939 | France | 63/15.4 |
| 264083 | 4/1929 | Italy | 63/15 |
| 20155 | of 1895 | United Kingdom | 63/15.1 |

*Primary Examiner*—Renee S. Luebke
*Assistant Examiner*—Michael J. Milano
*Attorney, Agent, or Firm*—Ladas & Parry

[57] ABSTRACT

The invention relates to circular pieces of jewelry having a rotating outer band and a process for manufacturing such jewelry. A circular piece of jewelry according to the invention includes an outer band which is coaxial with an inner band and which are mounted to rotate about their common axis. The inner band includes an inner ring having a central part placed between two thinner ends to which it is joined by two shoulders. The piece of jewelry further includes two lateral rings which abut against the two shoulders and which are welded on the ends after having engaged the outer band on the central part. The outer band is maintained captive in the groove defined by the two lateral rings in which it may rotate freely.

8 Claims, 2 Drawing Sheets

CIRCULAR PIECE OF JEWELRY COMPRISING AN OUTER BAND WHICH ROTATES AND PROCESS FOR MANUFACTURE

FIELD OF THE INVENTION

The present invention relates to jewels of circular shape such as rings, bracelets or pendants comprising a rotating outer band, and a processes for manufacturing such jewels.

The technical sector of the invention is that of the manufacture of jewels.

BACKGROUND OF THE INVENTION

Circular jewels such as rings or bracelets comprising a rotating outer band are already known.

U.S. Pat. No. 2,060,345 to Ch. PHILIPPS describes jewels, particularly rings or bracelets, which comprise an outer band on which precious stones may be crimped, which is mounted on a concentric inner band about which it may rotate freely.

According to one embodiment, the two bands are constituted by materials having a low coefficient of friction, for example celluloid.

If the two bands are made of metal, an anti-friction device is interposed therebetween, for example a ball bearing. In order to be able to assemble the two bands, one of them, preferably the inner band, is split so that it may be necked in order to be inserted in the outer band. The purpose is to produce jewels which enable the visible part of the outer band to be varied.

U.S. Pat. No. 2,453,955 to J. YOUNGHUSBAND describes a ring which comprises a plurality of precious stones and a cover which is mounted to rotate about part of said ring, this enabling a succession of stones to be covered or revealed in order to serve as memorandum.

U.S. Pat. No. 1,327,606 to S. BACHARACH describes wedding rings which are composed of three bands: a central band which comprises a pair of flanges and two lateral bands which each comprise a groove, in which one of said flanges penetrates, with the result that the three bands may rotate with respect to one another.

The purpose is to distribute the wear over the whole periphery of the ring. The inner band initially has an outer diameter smaller than the inner diameter of one of the lips which defines each of the grooves of the outer bands and the inner band is deformed in order to increase its diameter.

French Pat. No. 634 323 describes wedding rings formed by two concentric bands of different material, for the purpose of simplifying manufacture.

The inner band comprises a groove in which is engaged an outer band which has an initial outer diameter slightly greater than the outer diameter of the inner band and which is then necked so as to be firmly fitted in the groove.

In a variant, the inner band may be expanded. The outer band does not rotate in the inner band.

The prior art documents cited hereinabove show that it is known to manufacture circular jewels, particularly rings, comprising two coaxial bands which may rotate with respect to each other about their common axis for the purpose of distributing the wear or for enabling the ornamental appearance of the ring to be altered.

The purpose of the present invention is different.

Experience has shown that, for various reasons, certain people like to wear jewelry, particularly rings, bracelets or pendants, which comprise a rotating part, enabling them to occupy their fingers in rotating said part. The object of the present invention is to produce jewels which present this particular feature and to provide processes for manufacturing them.

A jewel according to the invention is of the known type comprising an outer band and an inner band, which are coaxial and mounted to rotate with respect to each other about their common axis.

SUMMARY OF THE INVENTION

The object of the invention is attained by a circular jewel in which the inner band comprises an inner ring having a central part which has an axial width slightly greater than the axial width of the outer band and an outer diameter slightly less than the inner diameter of said outer band and which is joined to a thinner end by a shoulder and the inner band further comprises at least one lateral ring which is engaged on said thinner end after said outer band has been engaged on the central part, which is placed in abutment against said shoulder and which is welded to said inner ring.

According to a preferred embodiment, the inner ring comprises a central part which is placed between two thinner ends to which it is joined by two shoulders and said inner band comprises two symmetrical lateral rings which are respectively engaged on said thinner ends and which each have a plane inner side which abuts against one of said shoulders, which lateral rings are welded on said inner ring and define therebetween and with said central part a peripheral groove in which is placed said outer band, whose axial width is less than the distance between said shoulders and whose inner diameter is less than the outer diameter of said lateral rings, so that said outer band may rotate freely in said groove in which it is maintained captive.

Each of the lateral rings advantageously comprises, on its inner periphery, a groove in which is placed a welding bead which enables said lateral ring to be welded to said central ring after having mounted the outer band between said lateral rings.

A first process of manufacturing a circular jewel according to the invention comprises the following operations:

- machining an outer band having determined axial width and inner diameter;
- machining an inner ring comprising a central part having an axial width slightly greater than the axial width of said outer band, and an outer diameter slightly less than the inner diameter of said outer band and comprising a thinner end which is joined to said central part by a shoulder;
- machining a lateral ring having an inner diameter slightly greater than the outer diameter of said thinner end and a plane lateral side;
- engaging said outer band on said central part then engaging said lateral ring on said thinner end until its plane side comes into contact with said shoulder and welding it to said inner ring in this position.

A second process of manufacturing a circular jewel according to the invention comprises the following operations:

- machining an inner ring comprising a central part which is joined to two thinner lateral parts by two shoulders separated by a determined distance;

machining an outer band having a determined axial width which is very slightly less than the distance between said shoulders;

machining two symmetrical lateral rings each comprising an inner peripheral groove and a plane inner lateral side;

placing in said peripheral grooves a welding paste bead;

fitting said outer band on the central part of the central ring, then fitting on the latter, respectively on either side of said outer band, the two lateral rings until they abut against said shoulders;

and introducing the jewel in a welding oven then removing it therefrom.

The invention results in novel circular jewelry, particulary rings, wedding rings, bracelets or pendants, which comprise two coaxial bands mounted to rotate with respect to each other, which enables the person wearing this jewelry to occupy his/her fingers in pivoting the rotating part.

The jewelry according to the invention is manufactured solely by machining pieces in the form of rings, fitting these pieces on one another and welding two outer rings, without requiring any permanent deformation of the pieces after they have been assembled.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
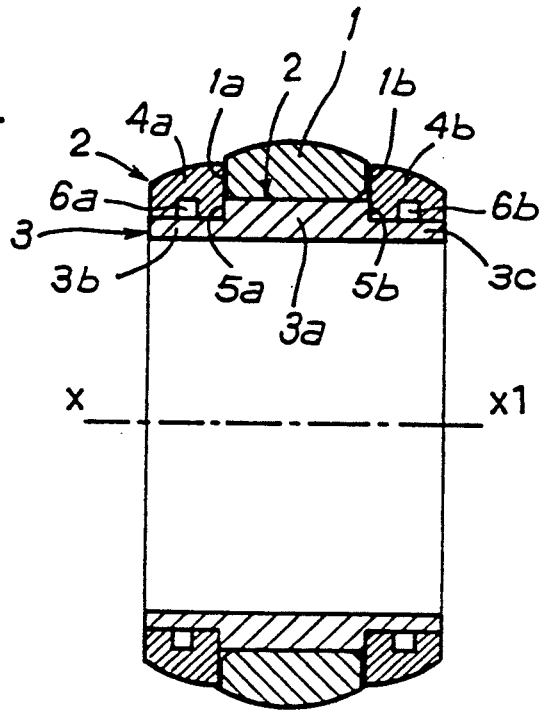
FIG. 1 is an axial section through a first embodiment of a piece of jewelry according to the invention.

Referring now to the drawings, FIG. 1 shows an axial section through a piece of jewelry of circular shape, of axis xxl, which is, for example, a ring, a wedding ring or a bracelet.

This piece of jewelry comprises two coaxial bands, an outer band 1 and an inner band 2 which are mounted to rotate with respect to each other about their common axis xxl.

The inner band comprises an inner ring 3 and two lateral rings 4*a* and 4*b*. The inner ring 3 comprises a central part 3*a* which is joined to two thinner lateral parts 3*b* and 3*c* by two shoulders 5*a* and 5*b*.

Figure 3:
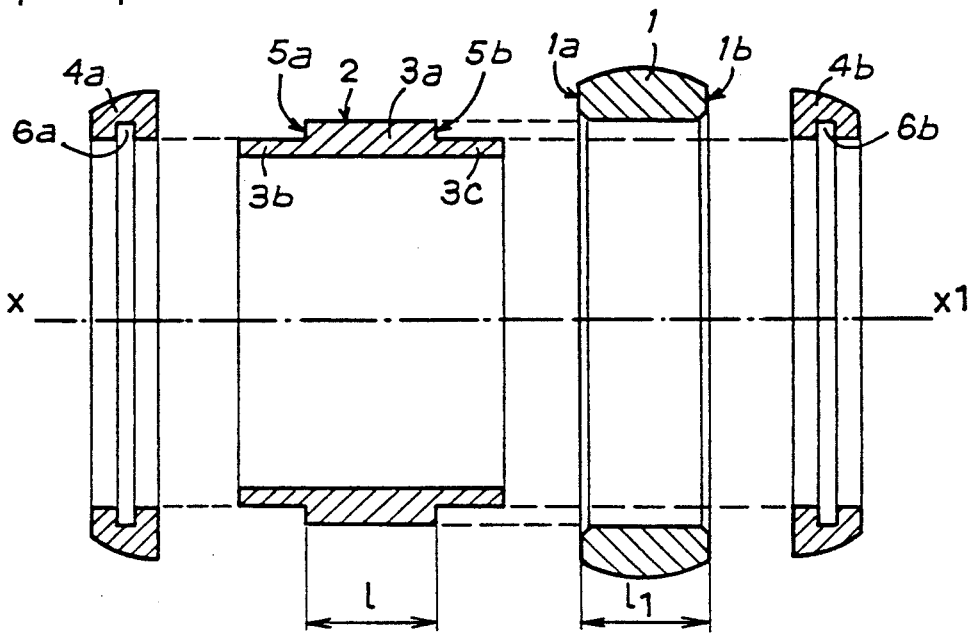
FIG. 3 an exploded view, in axial section, of a piece of jewelry according to FIG. 1 in the course of assembly.

FIG. 3 is an exploded view which shows the parts constituting a piece of jewelry according to FIG. 1, before being assembled.

The process of industrially manufacturing a piece of jewelry according to FIGS. 1 and 3 comprises the following operations.

An inner ring 2 of precious metal is machined, which comprises a central part 3*a* located between two thinner ends 3*c*, 3*b*, with the result that the central part joins the two ends by two shoulders 5*a* and 5*b*.

Machining is effected with high precision, so that the axial length L of the central part, which is the distance separating the two shoulders, is well determined, with a very small tolerance, of the order of 0.1 mm. The outer diameter of the central part 3*a* is also machined with high precision.

Two lateral rings 4*a*, 4*b* made of precious metal are machined separately, which have for example the form of a quarter circle and which are symmetrical with respect to a plane perpendicular to their axis.

The central sides of the two lateral rings, i.e. the sides facing each other, are in planes perpendicular to axis xxl.

The inner diameter of rings 4*a*, 4*b* is slightly larger than the outer diameter of the ends 3*b* and 3*c* of the inner ring.

An outer band 1 of precious metal is also machined, having an inner diameter which is very slightly greater than the outer diameter of the central part 3*a* of the inner ring and which is clearly smaller than the outer diameter of the lateral rings.

The outer band 1 is defined by two parallel lateral sides 1*a*, 1*b* which are perpendicular to axis xxl and which are machined with a very high precision, so that the width L, of the band is very slightly smaller than the axial width L of the central part 3*a* of the inner ring.

A peripheral groove 6*a*, 6*b* is advantageously machined in the inner face of each outer ring, in which groove is inserted a weld paste bead which corresponds to the nature of the precious metal constituting the rings.

The outer band 1 may be a simple band of precious metal. It may also comprise an adornment composed of precious stones set in the metal.

Once the rings have been machined separately, the outer band 1 is engaged on the central part 3*a* of the inner ring, on which it fits with a slight clearance sufficient for the two pieces to be able to rotate freely with respect to each other. The two outer rings are then respectively fitted on each of the ends 3*b* and 3*c* of the inner ring until they come into abutment against the shoulders 5*a* and 5*b*. They are maintained tightened against the shoulders, for example by means of a clamp or press, and the piece of jewelry is introduced in a welding oven, so that the weld paste which was placed in the grooves 6*a* and 6*b* welds the lateral rings 4*a* and 4*b* on the inner ring 3 with which they then form one piece. The lateral rings 4*a*, 4*b* define therebetween a peripheral groove in which the outer band 1 is maintained captive, as the inner diameter of the band 1 is clearly less than the outer diameter of the lateral rings 4*a* and 4*b*.

The width of the peripheral groove corresponds to the axial width L of the central part 3*a* of the inner ring, so that the outer band 1, whose axial width $L_1$ is very sligthly less than the width of the groove, may rotate freely therein, being guided by the sides of the two lateral rings 4*a* and 4*b*.

As opposed to the prior known processes, the process according to the invention makes it possible to manufacture pieces of jewelry comprising a rotating outer band without having to deform the outer band nor the inner band.

Figure 2:
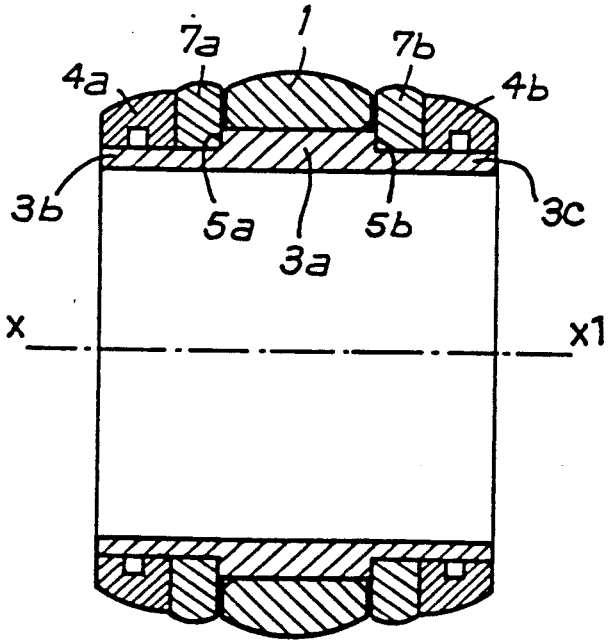
FIG. 2 is an axial section through a second embodiment of a piece of jewelry according to the invention.

FIGS. 1 to 3 show embodiments in which the lateral rings 4*a*, 4*b* may be composed of different precious metals or in different colours in order to give the jewel a particular outward appearance.

In a variant, when the inner band is composed of one metal, it may comprise one sole lateral ring, for example ring 4*a*, whilst the other lateral ring 4*b* is fast with the inner ring 3. In that case, an inner ring is machined, which comprises a central part 3a which is joined by one of its ends to a thinner end 3b by a shoulder 5a and which is joined by the opposite end to a thicker part 4b with which it is integral, which is machined on the outside to present the same appearence as ring 4a, for example in the form of a quarter circle as shown in FIGS. 1 and 3.

FIG. 2 shows another embodiment of a circular piece of jewelry according to the invention.

Homologous parts are designated by the same reference numerals.

The only difference resides in the fact that the jewelry according to FIG. 2 comprises a first pair of lateral rings 7a, 7b limited by two parallel sides perpendicular to axis xxl and a second pair of lateral rings 4a, 4b, which gives the jewelry a different surface appearance.

The inner lateral rings 7a, 7b are simply fitted on the ends 3b and 3c of the inner ring and maintained in abutment against shoulders 5a, 5b. They define the peripheral groove in which the outer band 1 rotates. The outer lateral rings 4a and 4b are welded on the ends 3b and 3c of the inner ring and they maintain the various pieces assembled.

Figure 4:
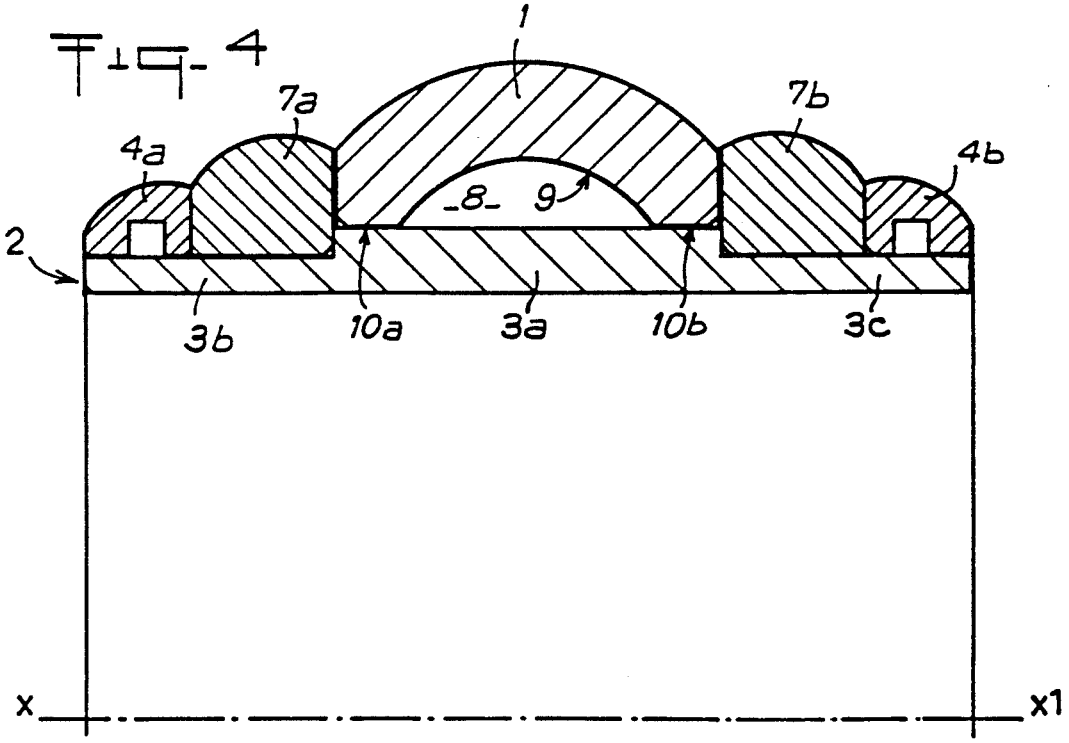
FIG. 4 is an axial half-section through a third embodiment of a circular piece of jewelry according to the invention.

FIG. 4 is an axial half-section of a third embodiment of a circular piece of jewelry according to the invention which comprises an outer band 1 mounted to pivot on an annular mount 2. Homologous parts are designated by the same references in FIGS. 1, 2 and 4.

The annular mount is similar to that of FIG. 2. It comprises an inner ring 3, two intermediate rings 7a, 7b and two lateral rings 4a, 4b which are welded on the two lateral ends 3b, 3c of the inner ring.

The difference with the embodiment according to FIG. 3 resides in the fact that the outer band 1 comprises an inner recess 8 which is defined for example by a circular inner surface 9 or by a surface in staircase form. This results in that the surface of the outer band which is in contact with the outer face of the ring 3a is reduced to two bands 10a and 10b, which has for its effect to reduce frictions between the two pieces and therefore to enable the outer band 1 to rotate by exerting a very weak effort and to reduce wear due to the frictions.

Moreover, the presence of a recess 8 presents the advantage of reducing the weight of precious metal used in the manufacture of the outer band 1 without altering the outside appearance of the jewelry.

What is claimed is:

1. In a circular piece of jewelry comprising an outer band and an inner band which are coaxial and mounted to rotate with respect to each other about their common axis, the inner band comprises an inner ring having a central part, which has an axial width slightly greater than the axial width of said outer band and an outer diameter slightly smaller than the inner diameter of said inner band and which is joined to a thinner end by a shoulder and at least a lateral ring which is engaged on said thinner end, after said outer band has been engaged on said central part, which is placed in abutment against said shoulder and which is welded to said inner ring, so that said lateral ring defines with said inner ring a peripheral groove in which said outer band is maintained captive and freely rotatable about the central part of said inner ring.

2. The circular piece of jewelry of claim 1, wherein said inner ring comprises a central part which is placed between two thinner ends to which it is joined by two shoulders and said inner band comprises two lateral rings which are respectively engaged on said thinner ends and which each have a plane inner side which abuts against one of said shoulders, which lateral rings are welded on said inner ring and define therebetween and with the central part a peripheral groove in which said outer ring is mounted captive and freely rotatable about said central part.

3. The piece of jewelry of claim 2, wherein each of said lateral rings comprises, on its inner periphery, a groove in which is placed a weld bead which welds said lateral ring to said central ring after having mounted the outer band between said lateral rings.

4. The piece of jewelry of claim 2, wherein said inner band comprises a central ring, a first pair of lateral rings, which abut against said shoulders and a second pair of lateral rings which abut against the first rings and are welded to said central ring.

5. The piece of jewelry of claim 1, wherein the outer band is defined by two lateral sides perpendicular to the axis.

6. The circular piece of jewelry of claim 1, wherein the outer band comprises an inner recess which reduces the friction surface and the weight of precious metal.

7. A process for manufacturing a circular piece of jewelry having an outer band and an inner band which are coaxial and mounted to rotate with respect to each other about a common axis, the process comprising the steps of:

machining the outer band so that said outer band has a predetermined axial width and inner diameter;

machining the inner band so that a central part of said inner band has an axial width slightly larger than the axial width of said outer band, an outer diameter of the central part is slightly smaller than the inner diameter of said outer band, and ends are formed on said inner band, which are joined to said central part by shoulders, and have an outer diameter that is smaller than the outer diameter of the central part;

machining at least two lateral rings so that an inner diameter of each said lateral ring is slightly greater than the outer diameter of said ends and that each lateral ring has a plane lateral side; and positioning said outer band around said central part and welding at least one of said lateral rings to each end so that the outer band and the inner band are mounted to rotate with respect to each other about said common axis.

8. A process for manufacturing a circular piece of jewelry having an outer band an inner band which are coaxial and mounted to rotate with respect each other about a common axis, the process comprising the step of:

machining the inner band to form a central part which is joined to two lateral parts by two shoulders separated by a determined distance, said lateral parts having a diameter less than the diameter of the central part;

machining the outer band so that said outer band has a predetermined axial width which is very slightly less than the distance between said shoulders;

machining a first inner set of at least two symmetrical lateral rings so that each ring has a diameter greater than the diameter of said lateral parts;

machining a second outer set of at least two symmetrical lateral rings so that each ring has a diameter greater than the diameter of said lateral parts and so that each lateral ring has an inner peripheral groove and a plane inner lateral side;

placing a weld bead in said peripheral grooves;

fitting said outer band on the central part of the central ring, then fitting thereon, on both sides of said outer band, the lateral rings from said first set until they abut against said shoulders, and then fitting thereon, on both sides of said first set of rings, the second set of lateral rings until they abut against said first set of lateral rings; and heating the piece of jewelry in a welding oven then removing it therefrom.

* * * * *